US005237783A

United States Patent [19]

DiRico et al.

[11] Patent Number: 5,237,783

[45] Date of Patent: Aug. 24, 1993

[54] TOWER POD FOR COMMUNICATIONS EQUIPMENT

[75] Inventors: Frank DiRico, 100 Marion Dr., Kingston, Mass. 02364; Lewis A. Foreman, Jr., Columbia, S.C.

[73] Assignees: Kline Iron & Steel Co., Inc., Columbia, S.C.; Frank DiRico, Kingston, Mass. ; a part interest

[21] Appl. No.: 775,564

[22] Filed: Oct. 15, 1991

[51] Int. Cl.[5] ..... E04B 1/34

[52] U.S. Cl. ..... 52/73

[58] Field of Search ..... 52/65, 73, 29, 646, 52/645, 648, 118, 148

[56] References Cited

U.S. PATENT DOCUMENTS

| | | | |
|---|---|---|---|
| 3,119,471 | 1/1964 | Turner | 52/118 |
| 3,125,189 | 3/1964 | Graham | 52/65 |
| 3,204,721 | 9/1965 | Park | 52/648 |
| 3,246,431 | 4/1966 | Faerber | 52/65 |
| 3,452,493 | 7/1969 | Mims | 52/73 |
| 3,633,325 | 1/1972 | Bartoli | 52/73 |
| 3,633,904 | 1/1972 | Kojima | 52/65 |
| 3,905,166 | 9/1975 | Kaiser | 52/65 |
| 4,912,893 | 4/1990 | Miller et al. | 52/148 |
| 4,918,459 | 4/1990 | De Teso | 343/872 |

FOREIGN PATENT DOCUMENTS

| | | | |
|---|---|---|---|
| 404168 | 6/1966 | Switzerland | 52/65 |
| 483526 | 2/1970 | Switzerland | 52/73 |
| 1186367 | 4/1970 | United Kingdom | 52/73 |

OTHER PUBLICATIONS

Kline Towers Publication of Oct. 1990 entitled "1000 Ft. Communication Tower", Miami, Fla., Preliminary Design For Cost Estimate for Frank Dirico of Industrial Electric and Electronis, Inc., of Kingston, Mass.

"The Adelphon Skypod" advertising drawing, Nov. 14, 1988.

*Primary Examiner*—James L. Ridgill, Jr.

*Attorney, Agent, or Firm*—Nixon & Vanderhye

[57] ABSTRACT

A pod for communications, research, navigation, and weather equipment, including antennas or sensors, has a skeleton formed by metal double channels and other metal structural elements, and is connected to a tower by rigid structural elements, including braces extending from below the pod to inner and outer beam rings of a floor skeleton. Fiberglass panels are connected to the floor and roof skeleton, and between the floor and roof skeletons, to form exterior and interior sides, defining an enclosure of sufficient integrity that it is water-tight, and may be air conditioned (heated and/or cooled). The exterior sides formed by the panels are contoured (e.g. curved about both horizontal and vertical axes), and the floor and roof panels are tapered, so as to provide an aerodynamic design of the pod. A dual set of railings is mounted on the roof with antennas connected to each set of railings, so as to provide maximum horizontal spacing of the antennas.

20 Claims, 10 Drawing Sheets

FIG 1
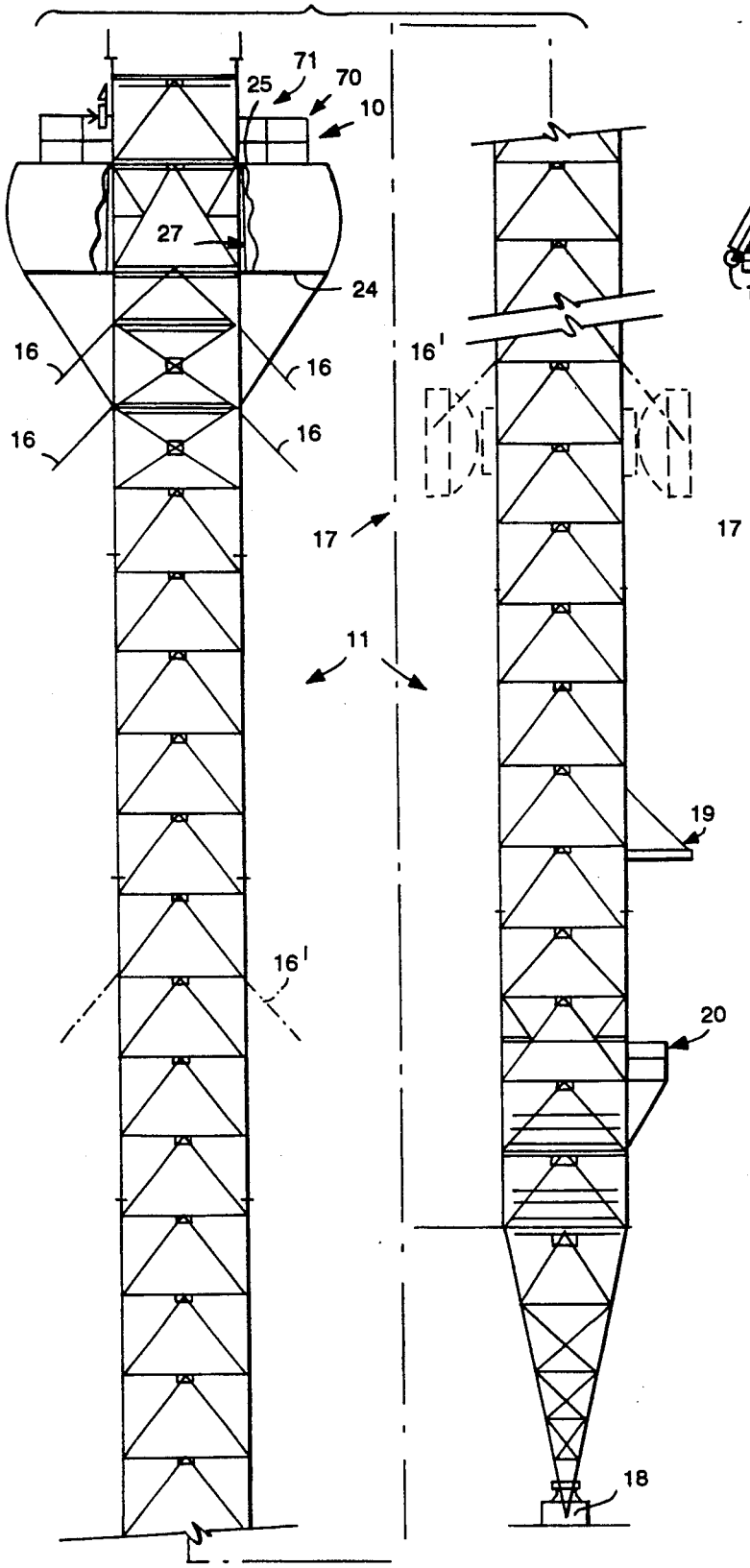
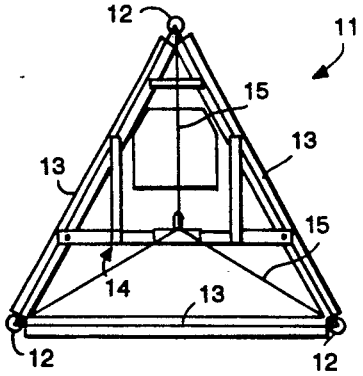
FIG 2

FIG 10
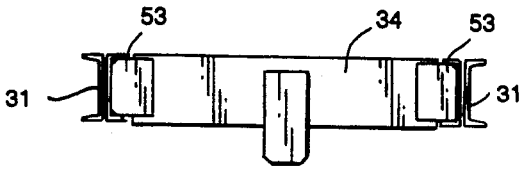
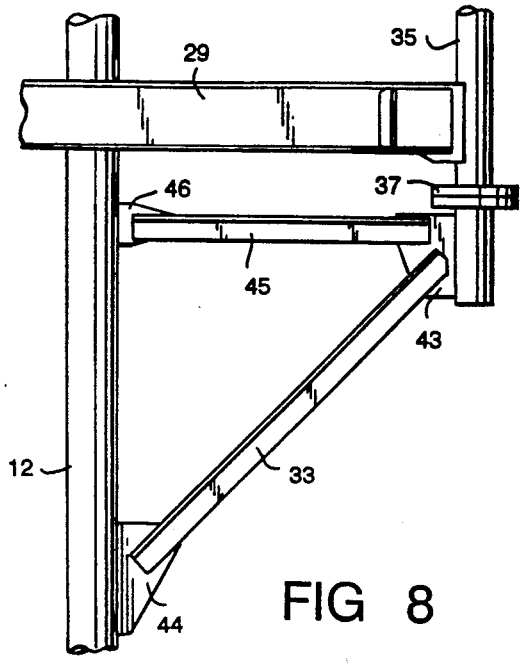
FIG 8
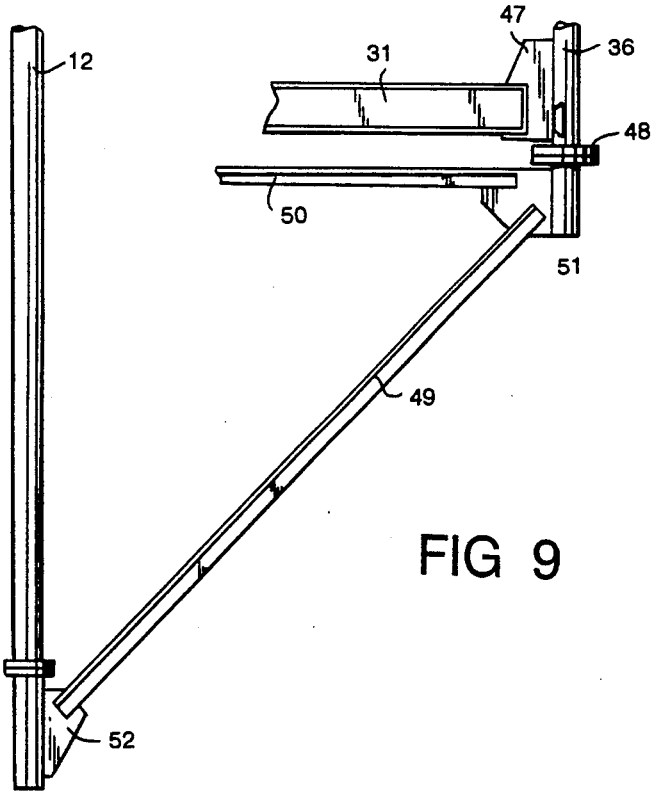
FIG 9

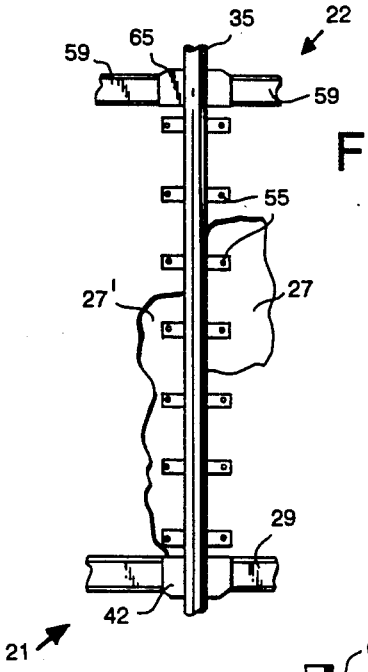
FIG 11
FIG 13
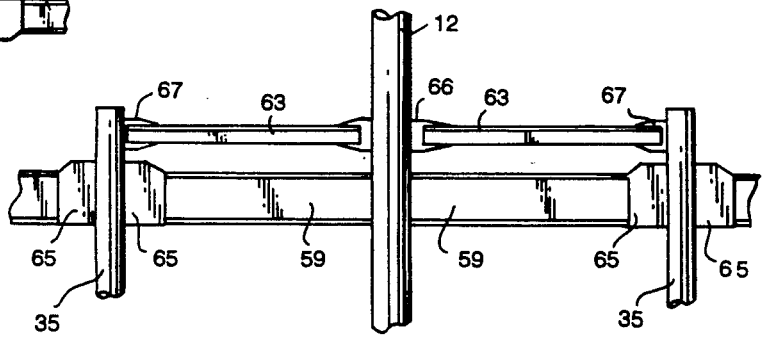
FIG 14
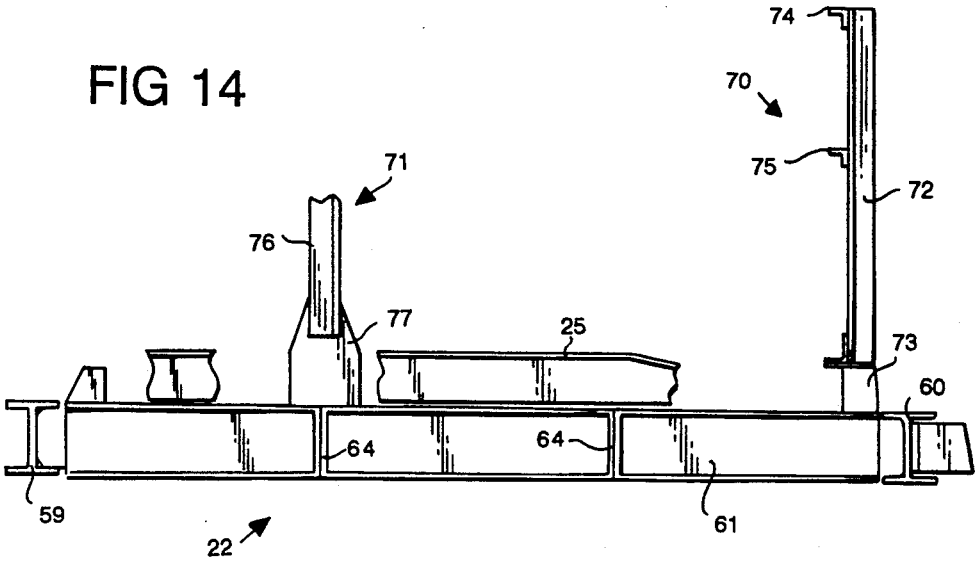

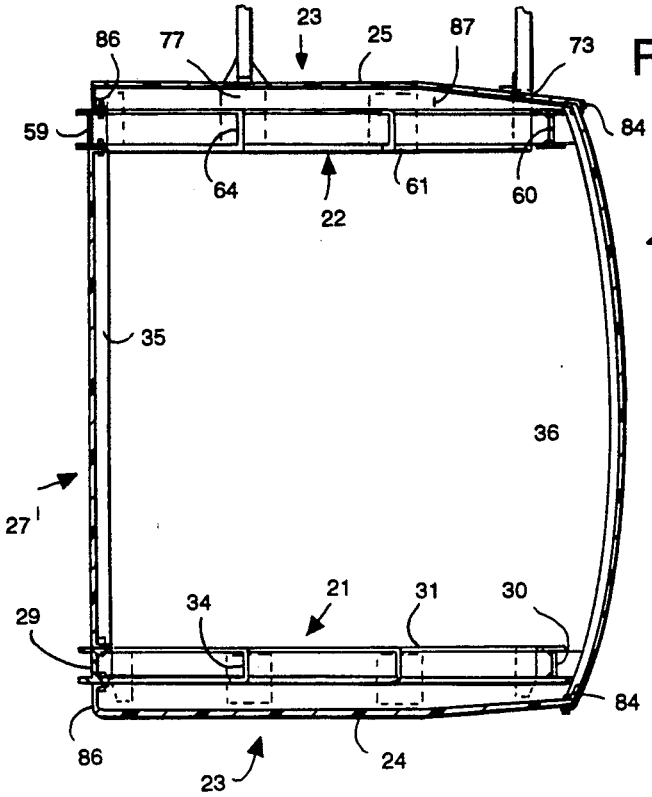
FIG 18
FIG 19
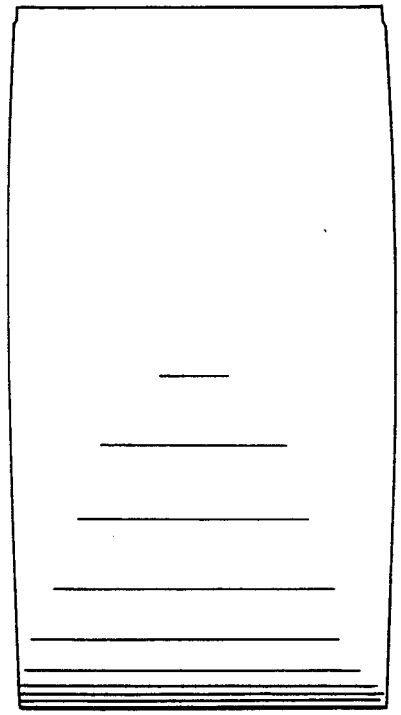
FIG 20
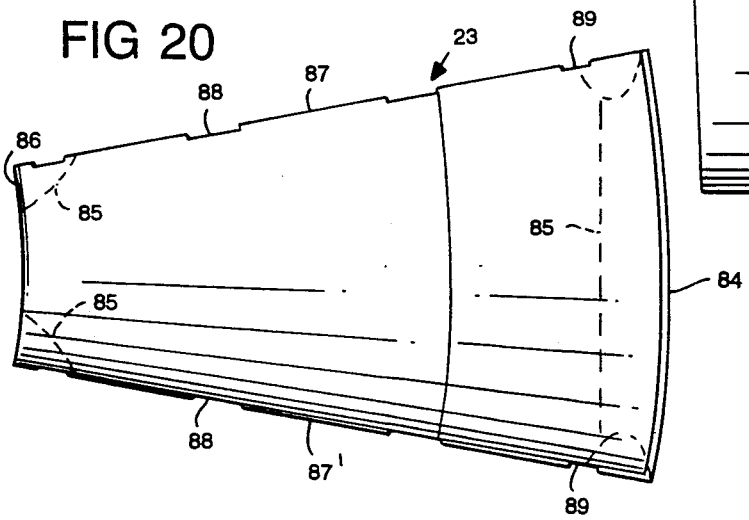

TOWER POD FOR COMMUNICATIONS EQUIPMENT

BACKGROUND AND SUMMARY OF THE INVENTION

A particularly effective way to mount communications equipment, such as microwave dishes, radio base stations, microwave radios, controllers, computers, broadcast transmitters, etc., is on a tall tower. This has been accomplished in the past by mounting the equipment on platforms that are formed with a minimum of structural steel. While prior towers have been functional, they have had one or more of the following shortcomings: not rain tight; not having sufficient integrity to be air conditioned (which is highly desirable for certain types of electronics equipment for communications) and in general a lack of any environmental controls; a relatively small size; a less than optimum horizontal spacing of antennas or an inability to mount a large number of antennas; also subject to the limitations of the wind loading imposed on the structure by varying size of coax cable or transmission lines and destructive forces from high winds as a result of a failure to take aerodynamics into account; and/or insufficient structural integrity to accommodate the installation of large amounts of heavy equipment and coax cables or transmission lines.

According to the present invention, a pod for use on a tower. A ground mounted pedestal, or a pedestal mounted atop a building or mountain, is provided which overcomes all of the above mentioned shortcomings. The pod according to the invention is made primarily from structural steel, including floor and roof skeletons formed by radiused H-beams, and including braces extending from portions on the tower below the pod to inner and outer rings of the floor skeleton, to provide high structural integrity. The pod according to the invention will readily accommodate large amounts of heavy equipment. Fiberglass, or like weather resistant panels, are connected to the structural skeletons (as with stainless steel fasteners) to provide a pod with sufficient integrity so that it is water tight under all weather conditions, having sufficient integrity and insulation so that it can be air conditioned.

The pod of the present invention also includes two sets of railings on the roof. The railings preferably are concentric with each other and the tower, and are dimensioned (with the outer railing at the outermost portion of the pod) so that optimum horizontal spacing between a large plurality of antennas may be provided. The panels are also constructed so as to provide an aerodynamic design. The exterior sides are blunt (preferably formed by panels each of which extend from the roof to the floor and are curved about both horizontal and vertical axes), with a taper of the roof and floor panels.

According to one aspect of the present invention, a pod for use on a tower (e.g. a triangular in cross-section tower having legs at the apexes thereof) is provided. The pod comprises: Means defining a floor skeleton for the pod. Means defining a roof skeleton for the pod. A first plurality of weather resistant panels connected to the floor and roof skeletons to form a floor and roof of the pod. A second plurality of weather resistant panels connected between the floor and roof skeletons to form exterior sides of the pod. A third plurality of weather resistant panels connected between the floor and roof skeletons to form interior sides of the pod. And, the means defining a floor skeleton comprising: a first formed radius of structural metal beams providing an inside ring; a second formed radius of structural metal beams providing an outside ring; a plurality of radially extending structural metal beams extending between the first and second formed radii; and a plurality of rigid structural metal elements connecting the inside ring to the tower.

A plurality of structural metal beams also are preferably provided for connecting some of the radially extending structural metal beams to the tower. The metal beams typically are H-beams. A plurality of straight structural metal elements may also connect the radially extending beams together to form, in plan, at least one, and preferably two, polyhedrons (e.g. 18 sided polyhedrons). The structural metal elements connecting the inner ring to the tower make comprise a plurality of vertical pipes extending between the roof and the floor skeletons, and operatively connected to the inner ring and to bracing structural metal elements connected to the tower. The structural metal elements may also be provided for connecting the outer ring to the tower, comprising braces extending from a portion of the tower below the floor skeleton to a vertical pole attached to the outer ring. The roof skeleton may be substantially identical to the floor skeleton.

The invention also contemplates the rain tight, air conditionable pod construction formed by the fiberglass panels connected by stainless steel connectors to the skeletons, as indicated above. Also the invention contemplates that the floor skeleton comprises structural substantially planar metal floor elements (e.g. H-beams) extending in a generally horizontal plane and having an inner portion (ring) closer to the tower and an outer portion (ring) farthest from the tower, and a plurality of rigid bracing members extending from the tower from a position below the pod to each of the inner and outer portions, so that the structural elements connect the floor and roof skeletons together so that the pod has sufficient integrity to support heavy equipment disposed within the pod mounted on the floor.

It is the primary object of the present invention to provide a strong pod with high integrity for mounting in association with a tower, for supporting communications equipment or the like. This and other objects of the invention will become clear from an inspection of the detail description of the invention, and from the appended claims.

BRIEF DESCRIPTION OF THE DRAWINGS

FIG. 1 is a schematic side view of an exemplary tower utilized with the pod according to the invention, with the majority of the tower (due to its height) cut away, and with the pod shown mounted adjacent the top of the tower;

FIG. 2 is a cross-sectional view of the tower of FIG. 1;

FIG. 8 is an elevation view looking in along lines 8—8 of FIG. 3;

FIG. 9 is an elevational view looking in along lines 9—9 of FIG. 3;

FIG. 10 is an elevation view looking in along lines 10—10 of FIG. 3;

FIG. 11 is a side view of an interior column gusset for attaching fiberglass panels to the structural skeleton;

FIG. 13 is an elevational view taken along lines 13—13 of FIG. 12;

FIG. 14 is an elevational view taken along lines 14—14 of FIG. 12;

FIG. 18 is a view like that of FIG. 17 only showing the pod cross-section at a radial beam;

FIG. 19 is an exterior end view of an exterior side panel of the pod;

FIG. 20 is a top plan view of an exemplary floor or roof panel of the pod; and

DETAILED DESCRIPTION OF THE DRAWINGS

Figure 3:
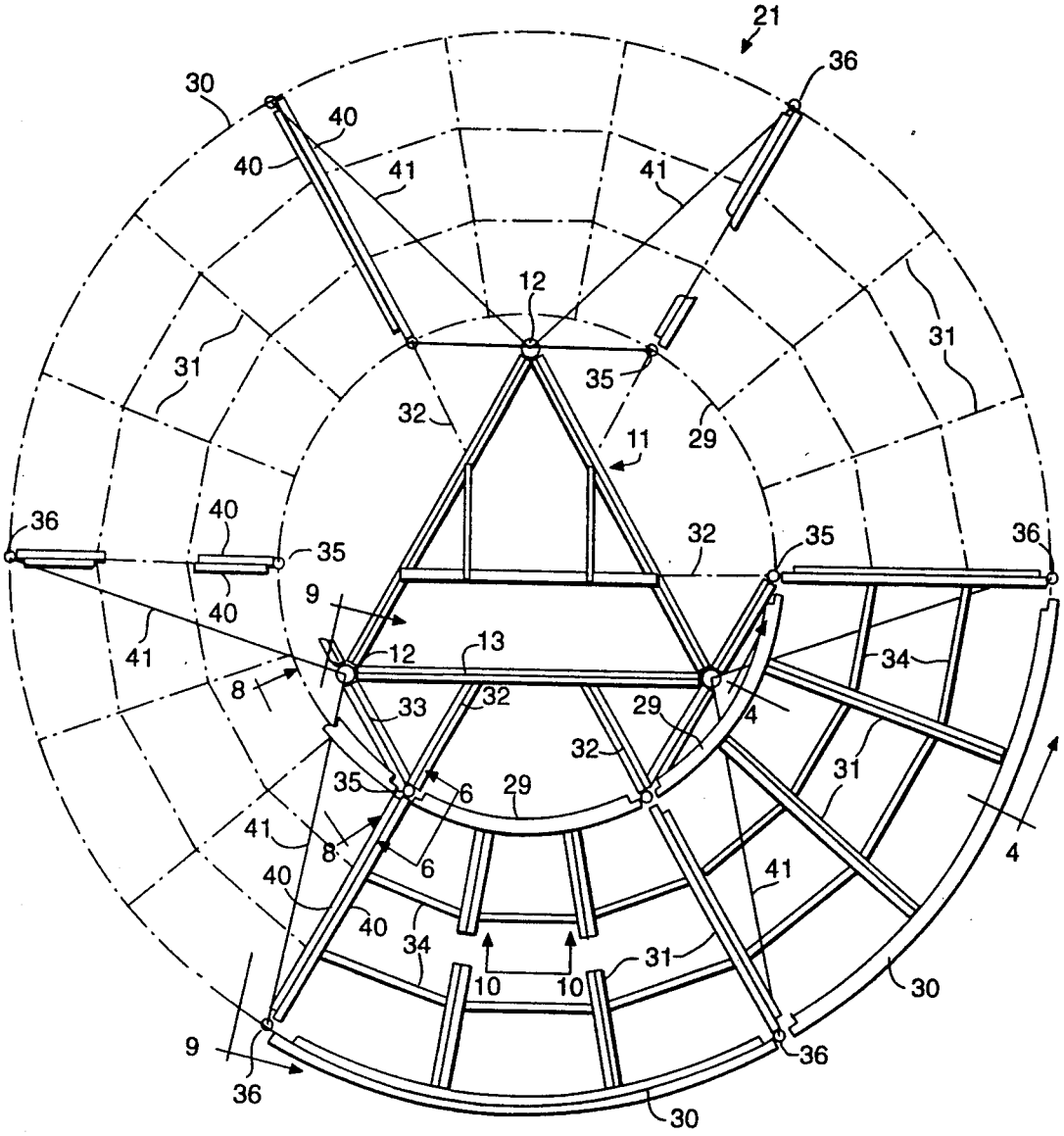
FIG. 3 is a schematic plan view of the floor skeleton of an exemplary pod according to the present invention.
Figure 4:
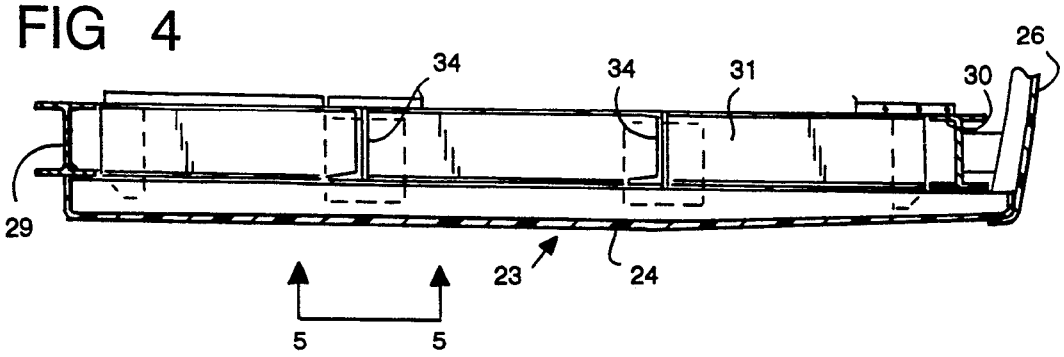
FIG. 4 is a sectional view taken along lines 4—4 of FIG. 3.
Figure 5:
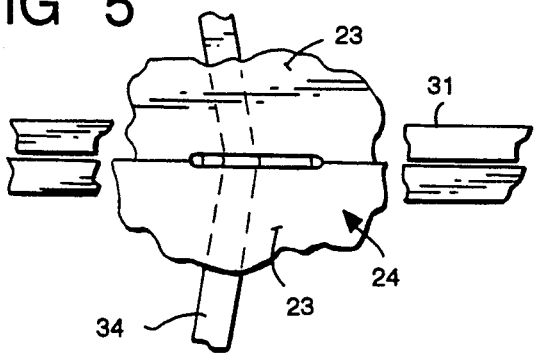
FIG. 5 is a detail view, with the floor in panel large part cut away for clarity of illustration, taken along lines 5—5 of FIG. 4.

An environmentally controlled pod, for containing communications equipment or the like, according to the present invention is shown generally by reference numeral 10 in FIG. 1. The pod 10 is supported on a tower 11 or the like of basically conventional design. Instead of a tower 11 as illustrated, the pod 10 may be mounted on a short structure on a roof top, mountain, or other high place. The term "tower-like support" is intended to encompass all such variations.

The tower 11 is typically formed of structural steel, and is polygonal in cross-section. The tower 11 illustrated in FIGS. 1 and 2 has a triangular shape, in fact an equilateral triangular shape, having three legs 12, one at each apex of the triangle, with structural steel rigid elements 13 extending between the legs, cross bracings shown generally by reference numeral 14, and internal tensioning wires 15 or the like. Also, guy wires can be provided at any point along the tower necessary to provide proper support, such as the guy wires 16 extending from the apexes of the triangles of the tower sections just below the pod 10, as well as other guy wires 16' that may be disposed at various other positions along the height of the tower. The tower may have any practical shape, or height (up to 2,000 feet or more).

Typically a pod 10 will be mounted adjacent the top of the tower, as illustrated in FIG. 1. Other pods may be provided along the tower at different heights, if desired. Also, other communications equipment can be mounted on the tower, for example the dishes 17 shown in dotted line in FIG. 1. Ultimately, the tower has a base 18, with the triangular sections of the tower 11 connected to the base 18 in a structurally appropriate manner. Various other structures that are conventional may also be mounted on the tower, such as a boom winch 19, bottom terminal landing 20, and the like.

The pod 10 includes a skeleton and weather resistant panels mounted to the skeleton. The skeleton preferably comprises means defining a floor skeleton 21—illustrated generally in FIG. 3 with various components illustrated in FIGS. 4 through 10—means defining a roof skeleton 22—illustrated generally in FIG. 12, with components illustrated in FIGS. 13 and 14. A first plurality of weather resistant panels 23—a typical panel being illustrated in FIG. 20—are connected to the floor and roof skeletons to form a floor 24 and a roof 25 (see FIGS. 1, 17, and 18). A second plurality of weather resistant panels are connected between the roof and floor skeletons 21, 22 to form the exterior sides of the pod 10—such as the panels 26 illustrated per se in FIG. 19, and also seen in FIGS. 1, 17, and 18. A third plurality of weather resistant panels are connected between the floor and roof skeletons 21, 22 to form the interior sides of the pod, one exemplary such panel being shown by reference numeral 27 in FIG. 21, and like (but not identical) interior panels being shown by reference numerals 27' in FIGS. 17 and 18.

The panels 23, 26, 27, 27' preferably are fire resistant fiberglass panels that are capable of resisting a 90 PSF loading, and having a thickness and chemical composition which allows them to resist that loading, and are assemblable to form a water tight structure. The fiberglass panels 23, 26, 27, 27' may or may not be insulated. The fiberglass panels 23, etc., are connected to the skeletons and like structural components by stainless steel fasteners, such as those supplied by I.E. & E. Inc.

The structural metal (typically steel) floor skeleton 21 is designed to provide maximum strength and integrity for the pod 10, and—in cooperation with the other components—will provide a floor rating which will accommodate the installation of communications equipment, which may be much heavier than can be conventionally utilized. Two of the basic elements of the floor skeleton 21 illustrated in FIG. 3 are a first formed radius of structural metal beams 29 providing an inside ring, having a diameter just slightly greater than the diameter of a circle through the apexes/legs 12 of the tower 11; and a second formed radius of structural metal beams 30 providing an outside ring concentric with the inside ring defined by the beams 29. Preferably the beams 29, 30 are H-beams of structural steel.

The floor skeleton 21 also comprises a plurality of radially extending structural metal beams 31 extending between the beams 29, 30, the beams 31 preferably being double channel structural steel. Also, the floor skeleton 21 comprises a plurality of rigid structural metal elements (e.g. bars, rods, angles, beams, etc.) connecting the inside beams 29 to the tower 11. These rigid structural elements connecting the inside ring beams 29 to the tower may comprise a plurality of structural metal beams 32 connecting the inner ring defined by beams 29 to the tower sides 13, and also may comprise elements 33 operatively connected between a tower leg 12 and the inner ring formed by the beams 29. Further, a plurality of straight rigid structural metal elements 34 may be provided connecting the radially extending beams 31 together to form, in plan, one or several (e.g. two as illustrated in FIG. 3) polyhedra (eighteen sided polygons in the embodiment illustrated). The floor skeleton 21 is operatively connected to the roof skeleton 22 by a plurality of vertical rigid elements, structural pipes 35 at the inner ring formed by the beams 29, and structural pipes 36 at the outer ring formed by the beams 30.

Figure 6:
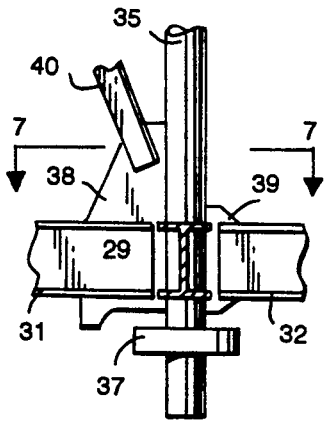
FIG. 6 is a detail view, partly in cross-section and partly in elevation, taken along lines 6—6 of FIG. 3.
Figure 7:
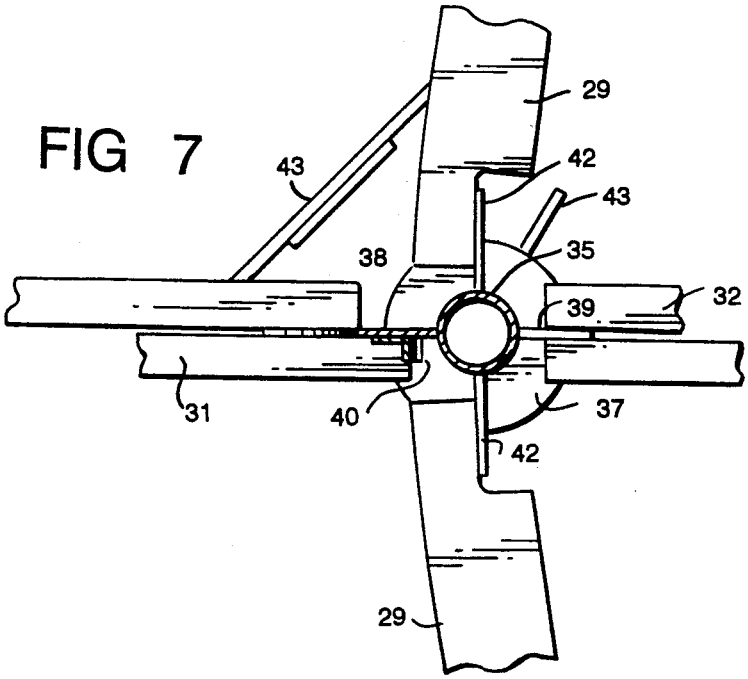
FIG. 7 is a view, partly in cross-section and partly in elevation, taken along lines 7—7 of FIG. 6.

FIG. 6 shows in detail the joint at a structural pipe 35 where a number of the elements are connected together. The structural pipe 35 has, adjacent a ring 37 thereon, an outwardly (from the tower 11) extending flange 38, and an inwardly extending flange 39. The double channel 31 is welded, riveted, bolted, or otherwise attached to the flange 38, while the double channel 32 is similarly attached to the flange 39. A radially outwardly and upwardly extending rigid structural element, such as a metal brace 40, may also be connected at the bottom end thereof to the flange 38, and at the top end thereof to the mid-point of double channel 31, with a similar structural element 40 being provided on the opposite side of the flange 38. Knee braces 49 also are provided below, connected between the pipes 36 and the tower legs 12. As seen in FIG. 7, the inner ring defining beams 29 also may be connected to flanges 42 extending from the pipe 35 essentially perpendicular to the flanges 38, 39, and if necessary short supporting braces 43 may be provided between the beams 29, 31.

Most of the elements described above with respect to the floor skeleton 21 are structural substantially planar metal floor elements extending generally in a horizontal plane. Some of the elements described above, and which will be described in more detail hereafter, provide a plurality of rigid bracing members that extend between the tower 11 below the pod 10, and the rest of the floor skeleton 21, to ensure that the floor skeleton has sufficient integrity—in combination with the other components—to properly support communications equipment.

FIGS. 8 and 9 illustrate the bottom brace members most clearly. As seen in FIG. 8, the structural element 33—also seen in FIG. 3—preferably is a rigid metal double angle connected at the top, most radially outward, end thereof to a flange 43 connected to the bottom of the pipe 35, below the ring 37 thereof, and at the bottom end thereof to a flange 44 extending outwardly from the tower leg 12. Again, attachment can be by any desired mechanism such as welding, rivets, or bolts. Also providing a cross brace—in addition to upwardly angled double angle structural element 33—is the rigid structural element (e.g. double angle) 45, connected between the flange 43 and a flange 46 extending from the tower leg 12.

FIG. 9 shows a radially inwardly extending flange 47 from the outer ring pole 36 connected to the radial beam 31, above a ring portion 48 of the pipe 36, and structure elements 49, 50 connected to a flange 51 at the bottom of the pipe 36, below the ring 48. The structural element 49 preferably is a rigid structural element, such as a double angle iron, connected at the top end thereof to the flange 51 and at the bottom end thereof to a flange 52 extending outwardly from the tower leg 12. The element 50 may likewise be connected to the tower leg 12.

FIG. 10 shows the interconnection between the beams 31 and elements 34, which is exemplified as being facilitated by the plates 53. The plates 53 may be, for example, welded to the beams 31, and bolted to the elements 34, or connected by other suitable mechanisms.

FIG. 11 illustrates an interior pole or pipe 35 interconnected between the floor skeleton 21 and the roof skeleton 22, and with a plurality of gussets 55 disposed along the length thereof for connection (by stainless steel fasteners) to interior fiberglass panels 27, 27', as schematically illustrated in FIG. 11.

Figure 12:
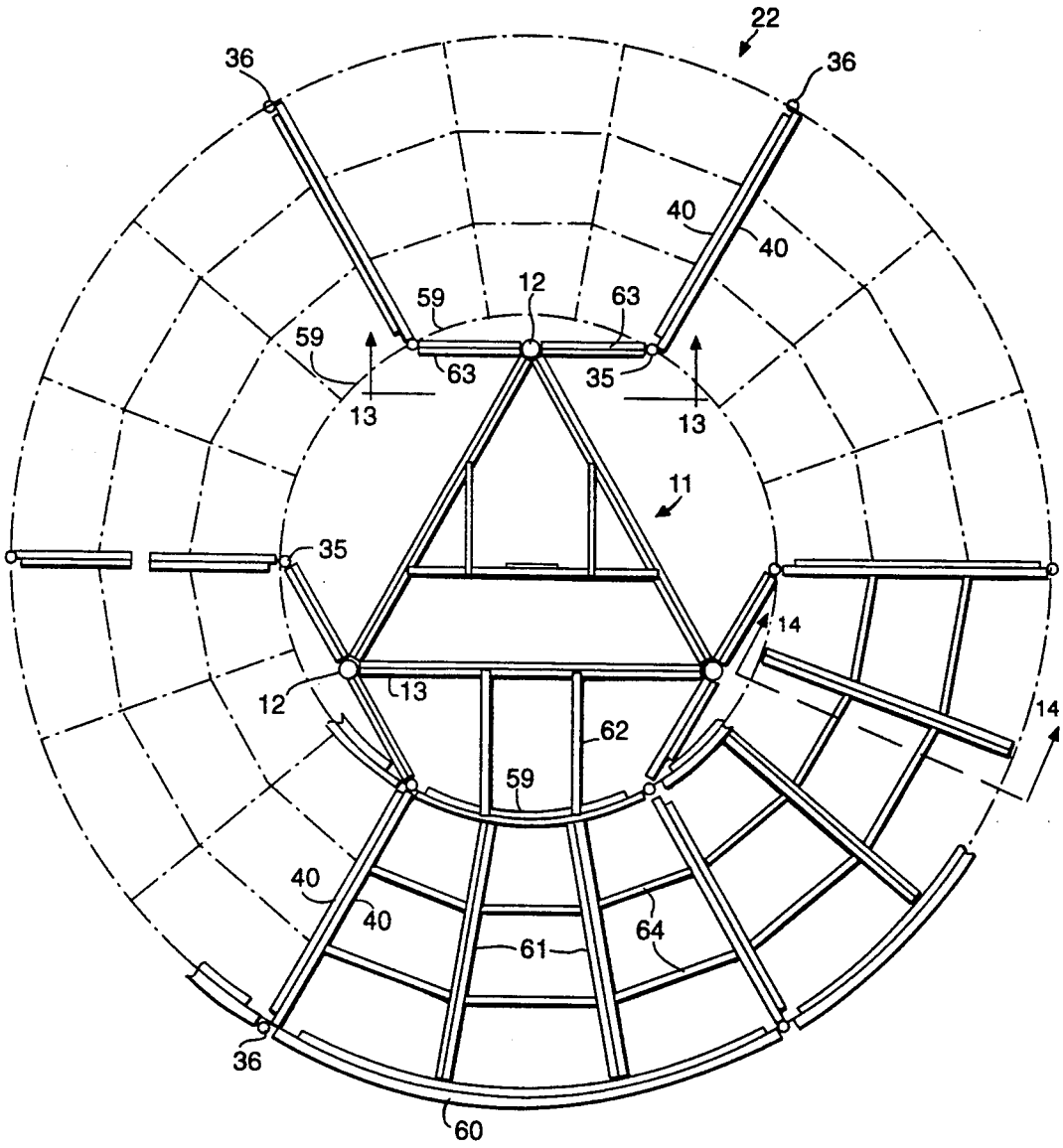
FIG. 12 is a view like that of FIG. 3 showing the roof skeleton.

The roof skeleton 22, illustrated in FIG. 12, is very similar—if not identical to—the floor skeleton 21. Elements that it has in common are the inner radiused beams 59 and outer radiused beams 60, radially extending beams 61, elements 62 (somewhat different than the elements 32) connecting the inner ring beams 59 to a tower leg 12, elements 63 (different than the elements 33) for connecting a tower leg 12 to the inner ring radiused beams 59 (through the pipes 35, as also seen in FIG. 13), and structural elements 64 extending between the radial beams 61.

Figure 15:
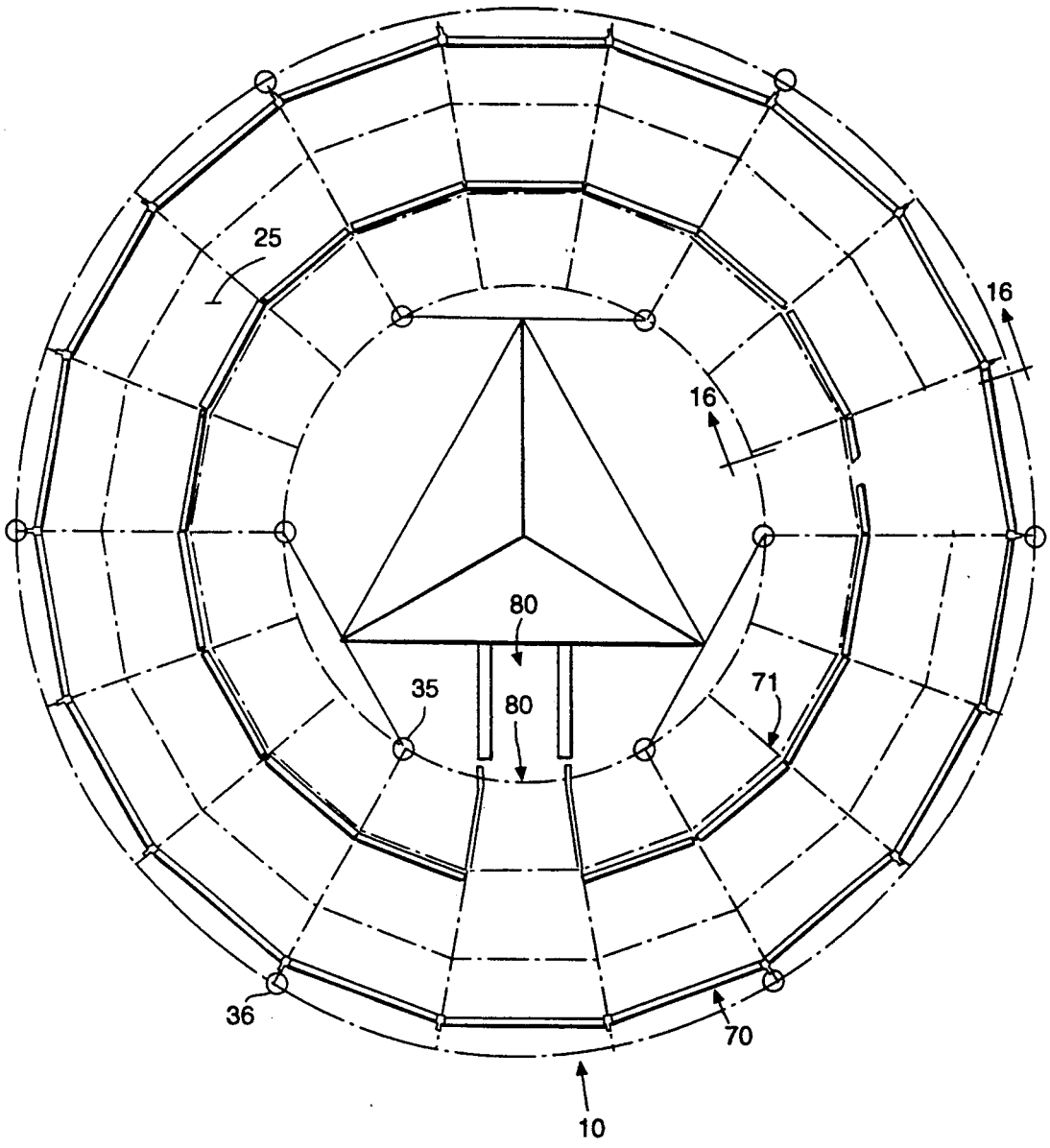
FIG. 15 is a view like that of FIG. 12 only showing the top railing construction of the pod.

As seen in FIG. 13, the inner beams 59 are connected to each other through flanges 65 extending outwardly from the pipes 35, again connection being made by any suitable mechanism such as welding, rivets, or bolts. The structural elements 63 are each connected at one end thereof to a flange 66 connected to a tower leg 12, and at the other end thereof to a flange 67 connected to a pipe 35. FIG. 15 shows the pod 10 from the top, with emphasis on the railing system provided thereby, including an outer railing system 70, and an inner railing system 71. FIG. 14—taken along lines 14—14 of FIG. 12—and FIG. 16—taken along lines 16—16 of FIG. 15—illustrate the cooperation between the railing systems 70, 71 and the roof skeleton 22.

The outer rail system 70 comprises a plurality of vertically upstanding rigid structural elements 72 (preferably angle irons), connected at the bottoms thereof to flanges 73 associated with the roof skeleton 22 (at joints between roof 25 panel 23), and top and middle horizontal rail elements (e.g. angle irons) 74, 75 respectively are provided interconnecting the vertical elements 72 to form the railing system 70. The inner rail system 71 is similar, having upstanding, vertical, structural elements 76 (such as angle irons) connected at the bottoms thereof to the flanges 77 (in the same radial plane as the corresponding flange 73), with horizontal rail elements 78, 79 disposed between adjacent vertical elements 76. The railings 70, 72 are provided not only to allow a qualified worker to safely work on top of the pod 10 (access being provided by the climb way 80 illustrated in FIG. 15), but also for connection of a plurality of antenna (e.g. 81) which extend vertically upwardly from the roof 25. By providing the dual rail system, security for qualified workers is provided, as is maximum horizontal spacing between a large plurality of antenna, one of which is shown schematically at 81 in FIG. 16, connected by a suitable co-axial cable 82 or the like to other communications equipment associated with the pod 10.

FIGS. 17 through 21 show details of the pod construction provided by the various panels 23, 26, 27, 27'.

Figure 17:
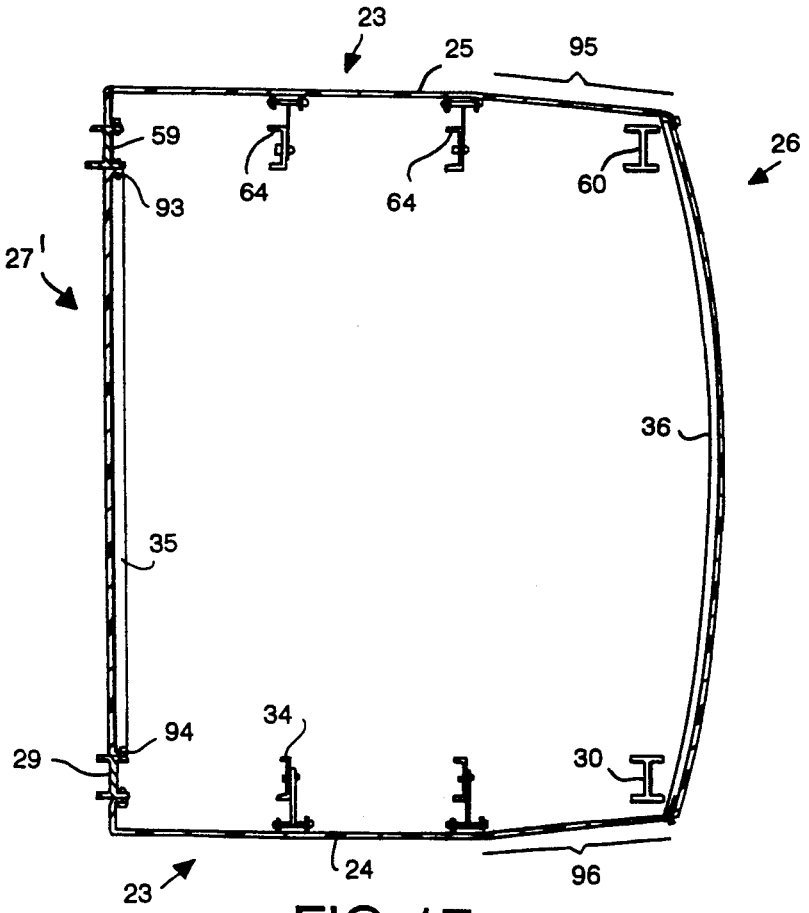
FIG. 17 is a cross-sectional view of the pod, including gussets for the connection of the fiberglass panels to the skeleton, showing a cross-section at mid panel.

As seen most clearly in FIG. 19 (also see FIGS. 17 and 18), the exterior panels 26 are preferably dimensioned so that they extend in one piece/panel from the roof skeleton 22 down to the floor skeleton 21, being connected at the top/inside thereof to a lip 84 on a roof panel 23, and on the bottom/outside thereof to a similar lip 84 on a bottom panel 23 (see FIGS. 17 and 18). The panels 26 are curved about both horizontal and vertical axes, so as to provide contoured sides to facilitate proper aerodynamic design.

The panels 23—as illustrated in FIG. 20—all have the general shape illustrated in FIG. 20, but will have different details depending upon their exact position around pod 10. For example, left or right hand interior or exterior cut outs—shown collectively in dotted line by reference numeral 85 in FIG. 20—are provided for when a particular panel 23 will be at a pipe 35 or 36. The bottom ones of the panels 23—forming a floor 24—will be oriented—and used—so that the outer lips 84 and inner lips 86 thereof face upwardly, while when used as a top panel the lips 84, 86 will face downwardly (see FIGS. 17 and 18).

Figure 16:
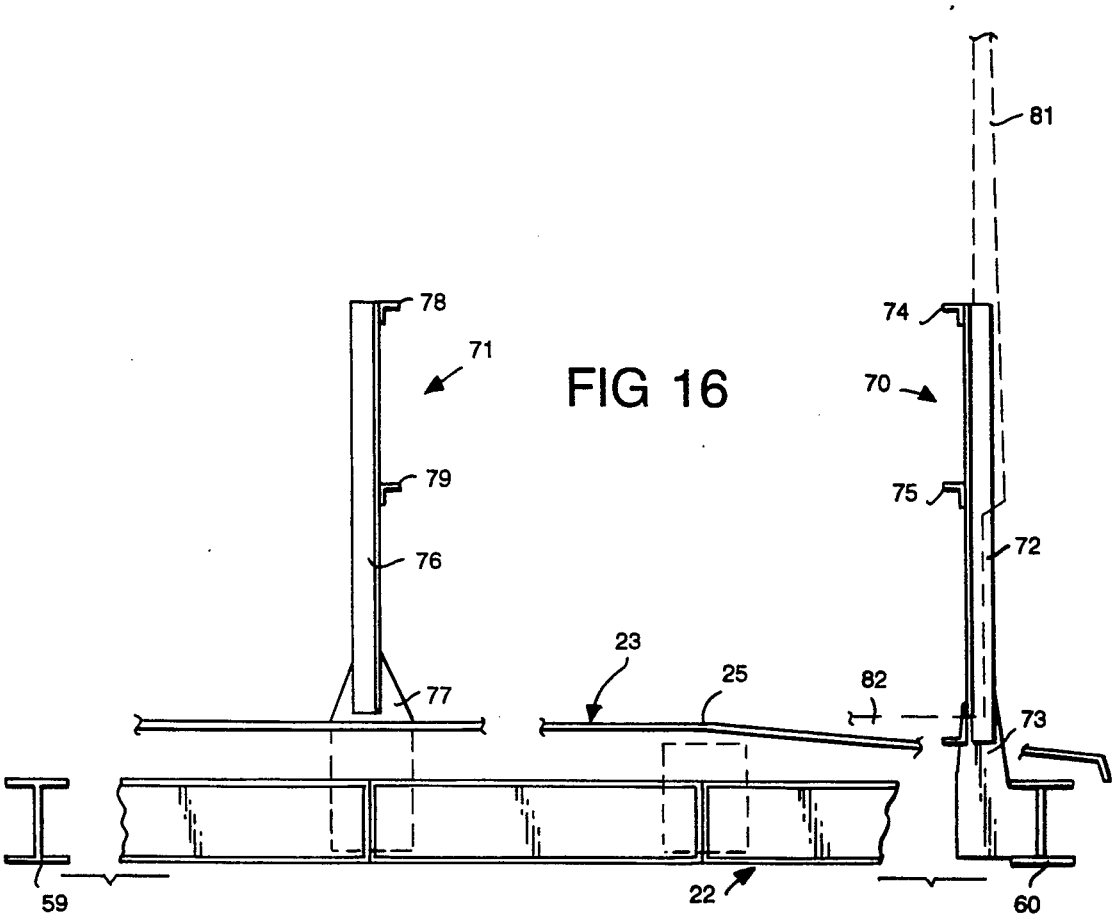
FIG. 16 is an elevational view taken along lines 16—16 of FIG. 15.

The panels 23 are connected to the exterior panels 26 and to the interior radiused beams 29, 59, by stainless steel fasteners or the like, as illustrated in FIGS. 17 and 18, and also preferably are connected to each other by side flanges 87 thereof, the side flanges 87 having cut outs for flanges associated with the structural components, such as (see FIG. 18 and 20) the cut outs 88 for the flanges 77, and the cut outs 89 for the flanges 73 (see FIGS. 16 and 18 too). Bolts, or other connectors, may be provided for connecting the side edges 87 of the adjacent panels 23 to each other, and a sealing compound, elastomeric material, or the like may be associated therewith to facilitate water tightness of the roof 25 and floor 24, if necessary.

Figure 21:
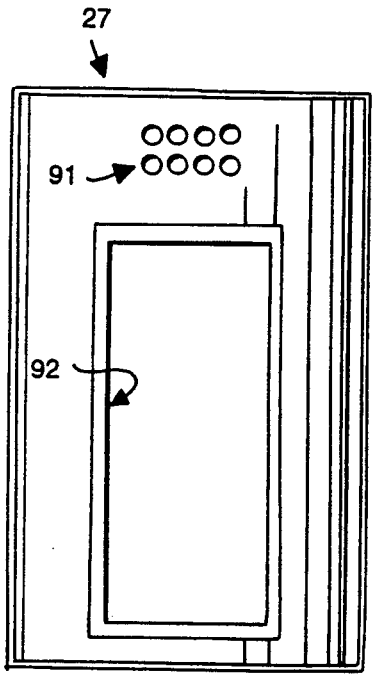
FIG. 21 is an interior end view of an exemplary interior side panel of the pod according to the invention.

The interior panels 27, 27' (see FIGS. 17, 18, and 21 in particular) will have a wide variety of constructions depending upon the particular details of that individual panel. For example, the panel may have a reinforced square opening therein for receipt of an air conditioner (e.g. Dayton Centrifugal Ventilator, or a heat pump), or—as illustrated in FIG. 21—may have a Microflect Wave Guide Entry assembly 91, and a doorway 92, such as for a 3×6 foot door providing access from the tower 11 to the interior of the pod 10. Some interior panels 27' will have no openings therein, while others may have reinforced openings for dampers associated with the air conditioning units (for heating and/or cooling), or the like. In any event, the panels 27, 27' are connected to each other at the vertical edges thereof by connection to the gussets 55 associated with the pipes 35—as illustrated in FIGS. 11, 17, and 18—and at the top thereof by fasteners extending through a top, inner, lip 93 to the bottom of the top inner ring, radiused beams 59, and by fasteners extending through an inner bottom lip 94 to the top of the inner ring radiused double channels 29. The floor and roof panels 23 are connected to the opposite portions of the beams 59, 29 as the lips 93, 94, as seen clearly in FIGS. 17 and 18.

Note that the construction of the pod 10 is such that there is a taper—seen generally by reference numerals 95 and 96 in FIG. 17—associated both with the roof 25 and the floor 24, which—in combination with the contoured exterior side panels 26—contributes to the aerodynamic design. Also, the pod construction, since it has maximum structural integrity due to the interior and exterior structural steel components, and the interconnections between the panels and the components, and between the panels themselves, as described above—provides an enclosure for equipment that is water tight (rain tight under any weather conditions) and with sufficient integrity (and insulation) of the enclosure that it may be air conditioned. Thus the equipment stays dry, and at the proper temperature for the communications gear that is mounted therein.

It will thus be seen that according to the present invention an extremely advantageous pod, for communication, research, navigation and weather equipment for mounting on a tower, building top, mountain top, etc., has been provided. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A pod for use on a tower-like support having an external cross-sectional area, comprising:

means defining a floor skeleton for said pod;

means defining a roof skeleton for said pod;

a first plurality of weather resistant panels connected to said floor and roof skeletons to form a floor and roof of said pod;

a second plurality of weather resistant panels connected between said floor and roof skeletons to form exterior sides of said pod;

a third plurality of weather resistant panels connected between said floor and roof skeletons to form interior sides of said pod, and spaced from the tower-like support;

said means defining a floor skeleton comprising a first formed radius of structural metal beams providing an inside ring; a second formed radius of structural metal beams providing an outside ring; and a plurality of radially extending structural metal beams extending between said first and second formed radii and connected thereto; and means for supporting said floor and roof skeletons, consisting essentially of rigid structural metal elements extending between the tower-like support and said skeletons, and including a plurality of rigid structural metal elements connecting said inside ring to the tower-like support;

said inside ring and said third plurality of panels defining an internal area much greater than that of the tower-like support cross-sectional area.

2. A pod as recited in claim 1 wherein said structural metal beams are double channels.

3. A pod as recited in claim 1 wherein said weather resistant panels are connected to said skeletons so as to provide an enclosure for equipment that is water tight and with sufficient integrity so that it may be air conditioned.

4. A pod as recited in claim 1 wherein said means defining a roof skeleton is substantially identical to said means defining a floor skeleton, in that it comprises: a first formed radius of structural metal beams providing an inside ring; a second formed radius of structural metal beams providing an outside ring; and a plurality of radially extending structural metal beams extending between said first and second formed radii.

5. A pod as recited in claim 4 further comprising a dual set of railings on the top of said roof skeleton forming rail inner and outer rings of railing, said rail outer ring essentially just above said roof outside ring.

6. A pod as recited in claim 1 wherein said exterior sides formed by said second plurality of panels are contoured, and wherein said first plurality of panels are tapered, so as to provide an aerodynamic design of said pod.

7. A pod as recited in claim 6 wherein said panels are fire resistant fiberglass.

8. A pod as recited in claim 6 wherein said second plurality of panels are curved about both horizontal and vertical axes, each panel operatively connected at the top thereof to said roof skeleton, and at the bottom thereof to said floor skeleton.

9. A pod as recited in claim 1 further comprising a dual set of railings on the top of said roof skeleton, each set of railings forming a rail ring concentric with said pod, and said railing sets concentric with each other.

10. A pod as recited in claim 9 further comprising a plurality of antennas mounted to each of said sets of railings, said rail rings positioned for maximum horizontal spacing of said antennas.

11. A pod as recited in claim 10 wherein the outer of said rail rings is essentially just above said floor outside ring.

12. A pod as recited in claim 1 wherein said supporting means further comprises a plurality of structural metal beams connecting some of said inner ring structural metal beams to the tower-like support below said floor skeleton.

13. A pod as recited in claim 12 further comprising a plurality of straight structural metal elements connecting said radially extending beams together to form, in plan, at least one polyhedron.

14. A pod as recited in claim 13 wherein said structural metal elements connecting the inner ring to the tower comprise a plurality of vertical structural pipes extending between said roof and floor skeletons, and operatively connected to said inner ring and to bracing structural metal elements connected to the tower-like support.

15. A pod as recited in claim 14 wherein the tower-like support is generally triangular in cross-section, having three apexes defined by vertical legs, and wherein each of said bracing structural metal elements is connected to a said vertical pipe, and to a said vertical leg, connected to said leg at a point below said floor skeleton.

16. A pod as recited in claim 14 wherein said supporting means further comprises structural metal elements connecting said outer ring to the tower-like support, said elements comprising a plurality of structural rigid metal braces each extending from a portion of the tower-like support below said floor skeleton, at an angle, to a vertical pipe attached to said outer ring, and between said outer ring and said roof skeleton.

17. A pod for use on a tower-like support, comprising:

means defining a floor skeleton for said pod;

means defining a roof skeleton for said pod;

a first plurality of weather resistant panels connected to said floor and roof skeletons to form a floor and roof of said pod;

a second plurality of weather resistant panels connected between said floor and roof skeletons to form exterior sides of said pod;

a third plurality of weather resistant panels connected between said floor and roof skeletons to form interior sides of said pod, and spaced from the tower-like support; and means for supporting said floor and roof skeletons, consisting essentially of rigid structural metal elements extending between the tower-like support said skeletons; and wherein said weather resistant panels are connected to said skeletons so as to provide an enclosure for equipment that is water tight and with sufficient integrity, and insulation, so that it may be air conditioned.

18. A pod as recited in claim 17 wherein said panels are fire resistant fiberglass, and wherein said exterior sides formed by said second plurality of panels are contoured, and wherein said first plurality of panels are tapered, so as to provide an aerodynamic design of said pod.

19. A pod as recited in claim 18 wherein said second plurality of panels are curved about both horizontal and vertical axes, each panel operatively connected at the top thereof to said roof skeleton, and at the bottom thereof to said floor skeleton.

20. A pod for use on a tower-like support, comprising:

means defining a floor skeleton for said pod;

means defining a roof skeleton for said pod;

a first plurality of weather resistant panels connected to said floor and roof skeletons to form a floor and roof of said pod;

a second plurality of weather resistant panels connected between said floor and roof skeletons to form exterior sides of said pod;

a third plurality of weather resistant panels connected between said floor and roof skeletons to form interior sides of said pod, and spaced from the tower-like support;

wherein said means for forming a floor skeleton comprises structural substantially planar metal floor elements extending in a generally horizontal plane and having an inner portion closest to the tower-like support, and an outer portion furthest from the tower-like support;

means for supporting said floor and roof skeletons comprising a plurality of rigid bracing members extending from the tower-like support from a position below said pod, to each of said inner and outer portions; and said roof skeleton having structural integrity and connected to said floor skeleton by rigid structural elements, so that said pod has sufficient integrity to support heavy equipment disposed within said pod, mounted on the floor.

* * * * *